US007387050B2

(12) United States Patent
Slettedal et al.

(10) Patent No.: US 7,387,050 B2
(45) Date of Patent: Jun. 17, 2008

(54) ROTATION UNIT FOR TORQUE TONG COMPRISING A ROTATIONAL PART WITH TEETH

(75) Inventors: Per Slettedal, Øvrebø (NO); Terje Egeland, Kristiansand (NO)

(73) Assignee: Aker Kvaerner MH AS, Kristiansand (NO)

( * ) Notice: Subject to any disclaimer, the term of this patent is extended or adjusted under 35 U.S.C. 154(b) by 0 days.

(21) Appl. No.: 10/546,821

(22) PCT Filed: Feb. 26, 2004

(86) PCT No.: PCT/NO2004/000054

§ 371 (c)(1),
(2), (4) Date: Jan. 26, 2006

(87) PCT Pub. No.: WO2004/076805

PCT Pub. Date: Sep. 10, 2004

(65) Prior Publication Data

US 2006/0196316 A1 Sep. 7, 2006

(30) Foreign Application Priority Data

Feb. 28, 2003 (NO) ..... 20030968

(51) Int. Cl.
*B25B 17/00* (2006.01)
*B25B 13/50* (2006.01)

(52) U.S. Cl. ..... 81/57.16; 81/57.22; 81/57.34

(58) Field of Classification Search ..... 81/57.16, 81/57.19, 57.18, 57.22, 57.34, 57.36, 57.21
See application file for complete search history.

(56) References Cited

U.S. PATENT DOCUMENTS

| | | | | |
|---|---|---|---|---|
| 2,650,070 | A * | 8/1953 | Lundeen | 81/57.18 |
| 2,879,680 | A * | 3/1959 | Beeman et al. | 81/57.18 |
| 2,989,880 | A * | 6/1961 | Hesser et al. | 81/57.18 |
| 3,541,897 | A * | 11/1970 | Horton | 81/57.18 |
| 3,691,875 | A | 9/1972 | Geczy et al. | |
| 4,200,010 | A | 4/1980 | Hewitt | |
| 4,334,444 | A | 6/1982 | Carstensen et al. | |
| 4,474,088 | A * | 10/1984 | Lee | 81/57.18 |
| 6,829,967 | B1 * | 12/2004 | Kemp | 81/57.15 |
| 7,028,585 | B2 * | 4/2006 | Pietras et al. | 81/57.16 |

FOREIGN PATENT DOCUMENTS

WO WO-98/26153 A1 6/1998

* cited by examiner

*Primary Examiner*—Hadi Shakeri
(74) *Attorney, Agent, or Firm*—Birch, Stewart, Kolasch & Birch, LLP

(57) ABSTRACT

A rotation unit for a torque tong for making and/or breaking threaded connections between pipes and/or spinning pipes during screwing and/or unscrewing of pipes, primarily pipes used in petroleum production. The unit includes a fixed part and a rotary part arranged to grip a pipe to be rotated. The rotary part includes at least one movable gripping jaw arranged to be moved into engagement with the pipe. The rotary part includes toothing arranged to engage at least one chain, which is operatively connected to an actuator in order to move the chain and so impart rotary movement to the rotary part.

10 Claims, 8 Drawing Sheets

4
70
80
82
83
1
1a
81

4
81
80
70
1
1a 4
80
81
70
1
1a

ROTATION UNIT FOR TORQUE TONG COMPRISING A ROTATIONAL PART WITH TEETH

The present invention regards a rotation unit for a torque tong in accordance with the preamble of the appended claim 1.

A prior art torque tong is described in NO 163973, which concerns a torque tong arranged both to break and make a threaded connection between two pipes, and also spin one of the pipes relative to the other in order to uncouple the pipes from each other or tighten the connection.

In older solutions, a special device was used to make and break the connection, while another special device was used to spin the pipes apart or together. The solution of NO 163973 allowed both making/breaking and spinning to be carried out in the same apparatus.

The solution of NO 163973 also entailed the advantage of being able to handle pipes within a wide range of diameters.

In order to achieve this, NO 163973 proposes the use of one or more master cylinders which upon rotation of the rotary part of the tong, and as a result of the placement of the cylinders, are pressed together, applying pressure to a number of slave cylinders. The slave cylinders will in turn displace jaws to engage one of the pipes involved, ensuring that these maintain a sufficiently powerful grip on the pipe to break or make the connection to a prescribed torque without the jaws slipping relative to the pipe.

A solution similar to that of NO 163973 has been described in NO 306572. Here the jaws are also equipped with respective slave cylinders. These are pressurized by a master cylinder mounted on the rotary part, which master cylinder is then influenced by a piston mounted outside the rotary part. The jaws are brought into engagement with the pipe by increasing the pressure from the master cylinder Valves ensure that the pressure in the slave cylinders is maintained independently of the master cylinder.

In a subsequent patent application (WO 00/45027) from the same applicant as NO 306572, it is stated that in the solution of the latter patent, the piston must push the master cylinder repeatedly in order to provide a sufficient volume of hydraulic fluid to push the jaws into engagement and also achieve sufficient retaining power. This causes a significant delay in the operation. In WO 00/45027, this problem is apparently solved by means of pressure accumulators.

Rotation of the rotary part is largely achieved by use of cogwheels directly engaged with toothing on the rotary part.

The present invention provides a drive system for rotating the rotary part of the tong.

This system has advantages over the existing systems, which are mainly based on geared drive through several gear wheels placed along the periphery of the rotary part.

These advantages are achieved by the characteristics that appear through the characterising part of claim 1.

The rotary part has an opening at the periphery for introduction of a pipe, and the chain extends across a sector of a circle larger than the opening, thus ensuring that the chain and the toothing on the rotary part are engaged at all times.

The rotary part is directly engaged with at least two chains that act synchronously, thus reducing the strain on the chain.

The chains are arranged on diametrically opposite sides of the rotary part, thus giving a symmetric loading on the rotary part.

The rotary part has replaceable teeth, thus simplifying maintenance.

The chain extends over a first cogwheel operatively connected to a motor, e.g. a hydraulic motor, and a second cogwheel that acts as a turning wheel, the cogwheels being spaced apart at the periphery of the rotary part; this provides a compact solution with few components.

A distance over which the chain extends between the teeth located nearest the opening, on either side of this, is equivalent to a whole number (integer) of teeth, thus ensuring that the chain lands on a tooth on the opposite side of the opening upon passing over this.

The rotary part is equipped with an uneven number of teeth, making it easier to ensure that the distance over which the chain extends between the two teeth nearest the opening, is equivalent to a whole number of teeth.

By making the number of teeth 21, a practical solution is obtained, whereby the chain will always land on a tooth when passing the opening.

The rotary part is slidingly supported on a plate on the fixed part, thus achieving cost effective and secure support of the rotary part.

A chain drive ensures a more robust design and smoother running. Smoother running reduces the risk of "bite marks" from the jaws on the pipe. The chain will engage the rotary part across a significantly longer area than a cogwheel. This will reduce the loading on each tooth on the rotary part, and compared with direct engagement between a cogwheel and the rotary part, the loading on the chain will be more even. Moreover, the chain will be able to engage the rotary part over a section large enough to ensure that even if the rotary part does not have teeth around its entire periphery (e.g. due to an opening for introduction of pipes), the chain will be in engagement with the rotary part at all times. This would not be the case in the event of a direct engagement with cogwheels, where the cogwheels would engage and disengage the rotary part at every rotation. This increases the strain and the risk of damage to both cogwheels and teeth on the rotary part.

In the case of direct engagement with a cogwheel, the component most exposed to wear will be precisely the cogwheel. In the case of chain drive, it will be the chain. It is easier to replace a worn or damaged chain than a cogwheel, as a cogwheel inevitably of necessity would have to be securely fixed to the shaft, while the chain is arranged more or less loosely around the cogwheels. In addition, the teeth on the rotary part may be arranged so as to be replaceable, allowing easy replacement of worn or damaged teeth. The tong will be usable even with missing teeth, as the chain will be in engagement with other teeth. Drive systems incorporating a chain will not be as sensitive to dirt as drive systems based on e.g. direct gearing. The noise generated by the system will also be less.

Furthermore, the costs of producing such a system could also be lower.

The invention will now be described in greater detail by means of an example of an embodiment shown in the accompanying drawings, in which.

Figure 3:
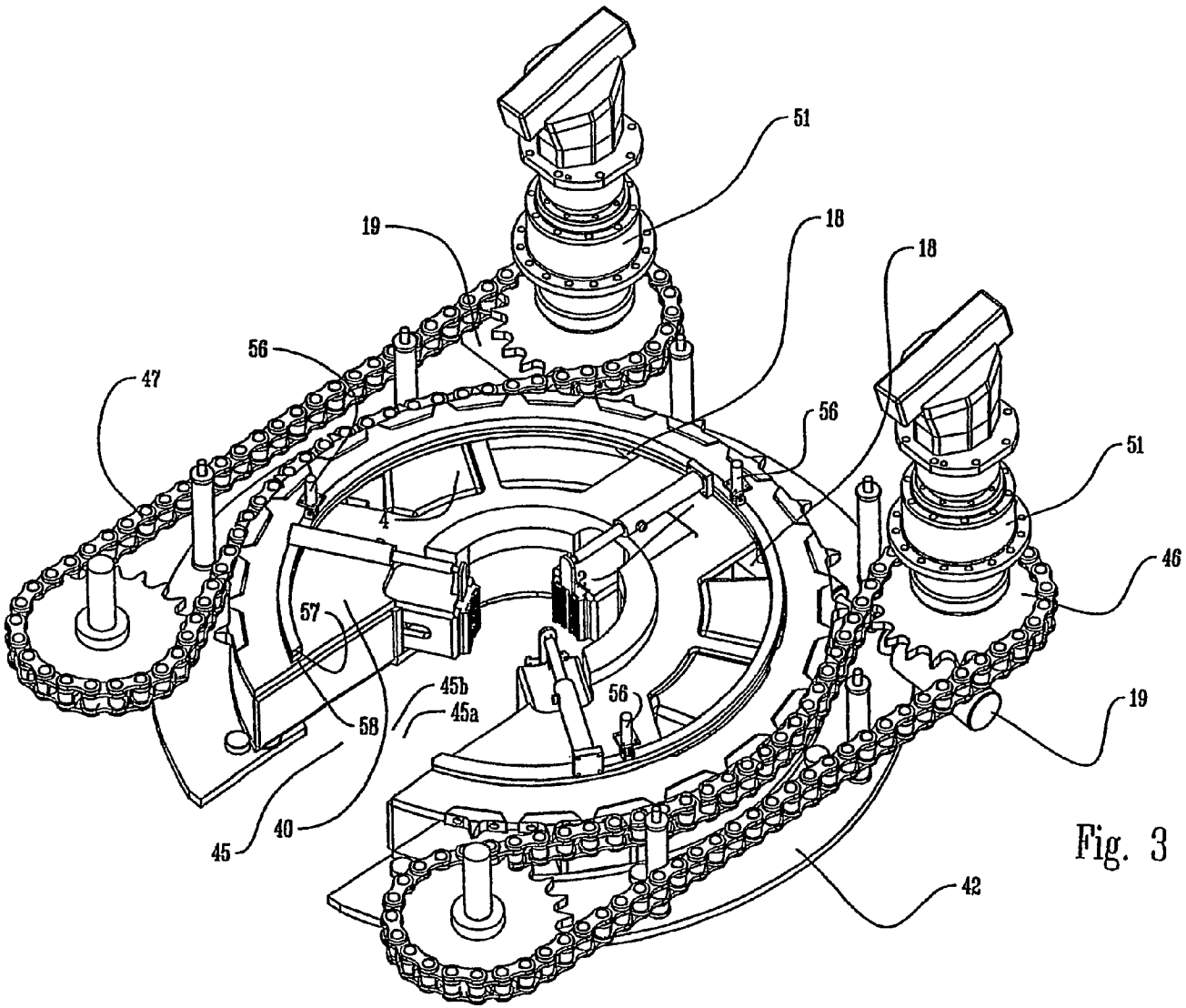
Figure 4:
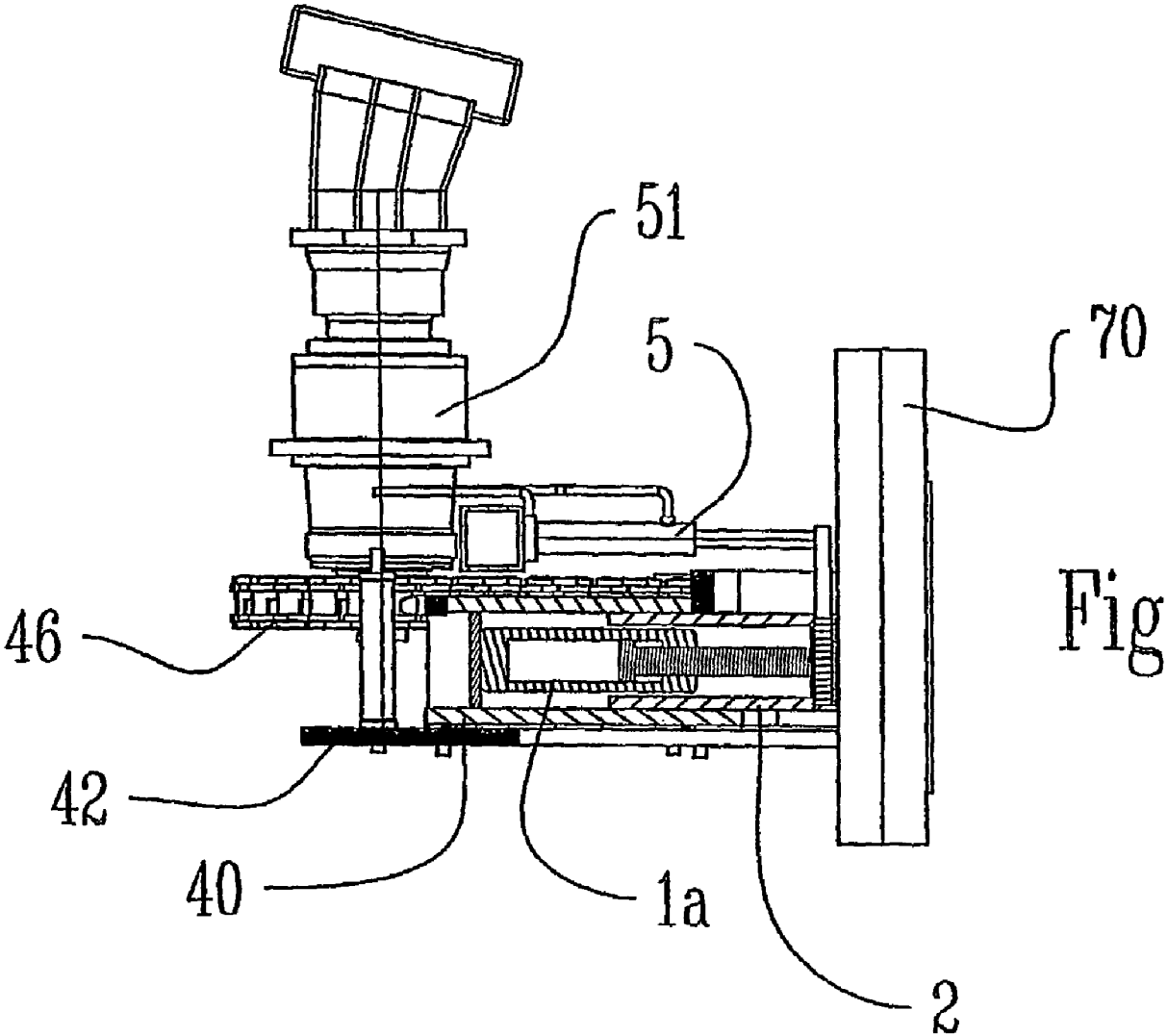
Figure 5:
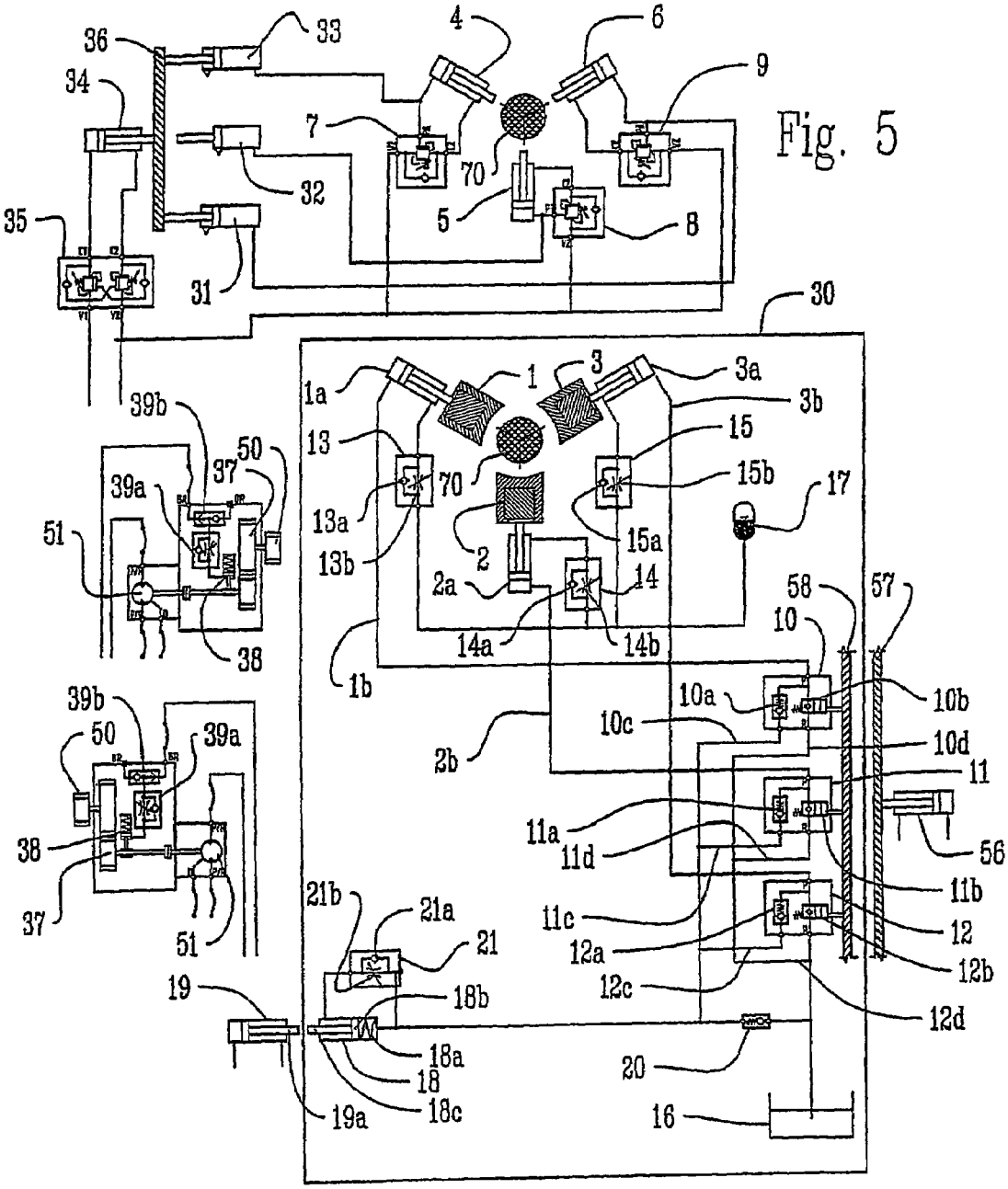
Figure 6:
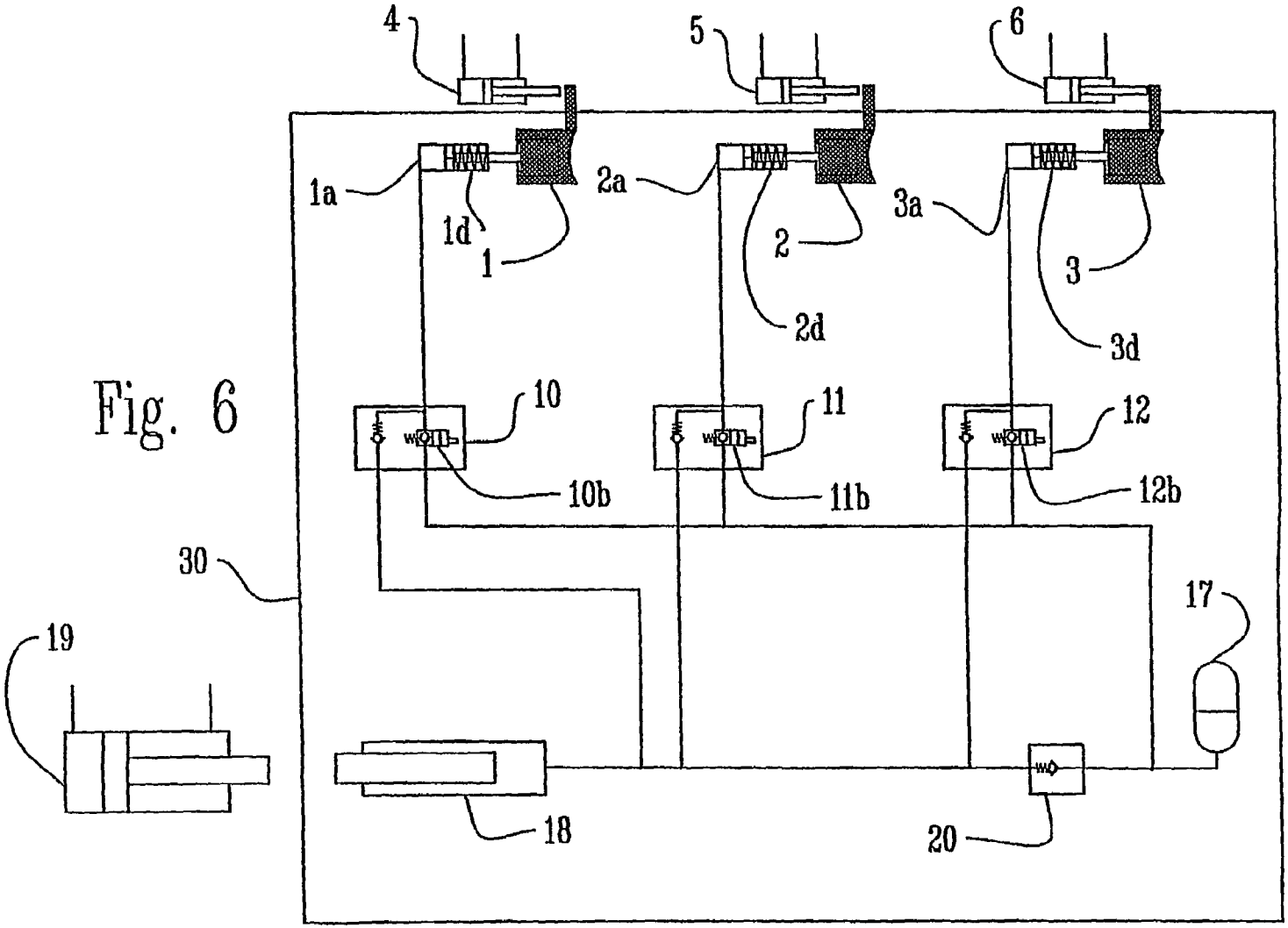

FIG. 3 mainly shows the rotary part of the rotation unit;

FIG. 4 is a sectional view of the rotation unit;

FIG. 5 shows a hydraulic connection diagram of the most important components that bring about the gripping of the pipe;

FIG. 6 shows an alternative hydraulic connection;

FIG. 7 shows alternative gripping and holding means, with

Figures 7A, 7B, 7C:
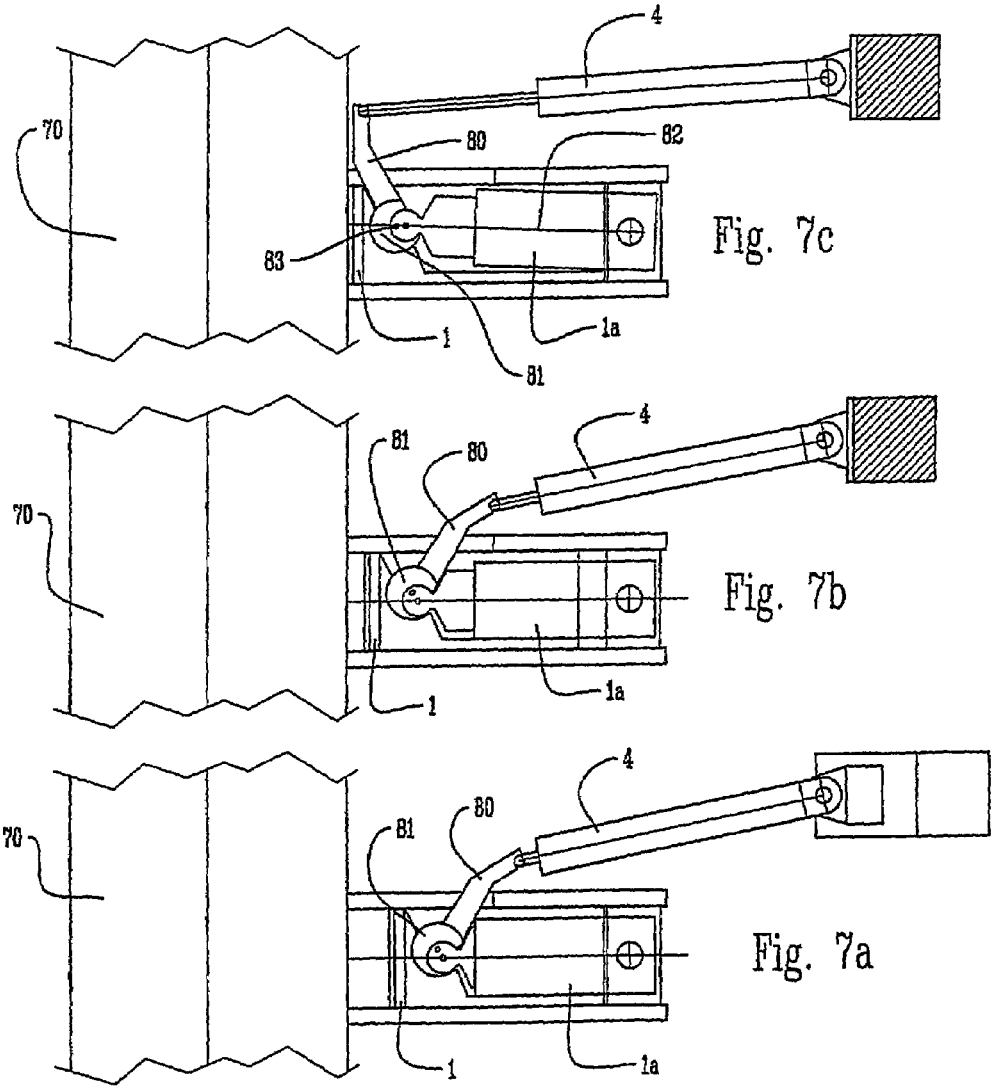
Figure 8:
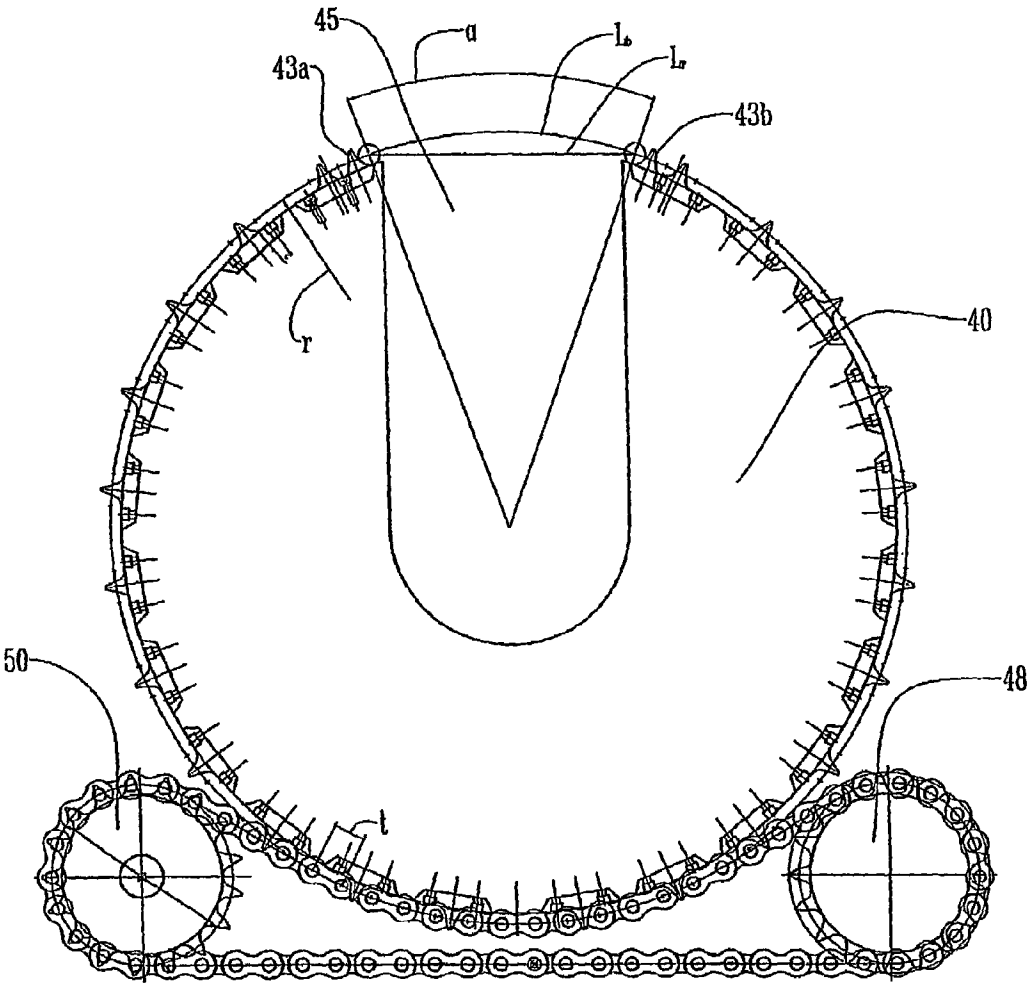

FIG. 7*a* showing a jaw fully retracted from the pipe;

FIG. 7*b* showing the jaw about to be pushed into engagement with the pipe; and FIG. 7*c* showing the jaw fully engaged with the pipe; and FIG. 8 illustrates a principle for distribution of teeth on the rotary part.

Figure 1:
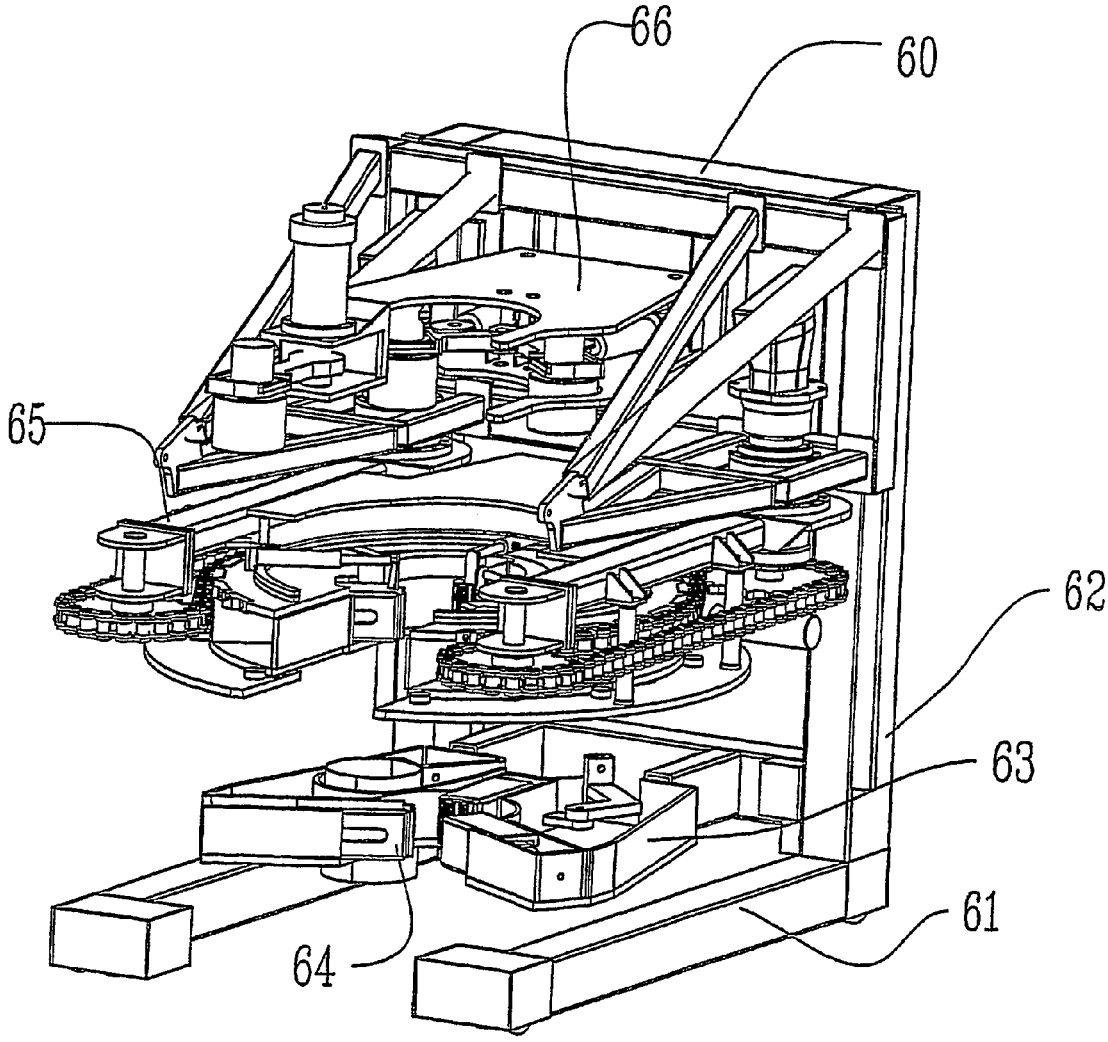
FIG. 1 shows a rotary torque tong according to the present invention.

FIG. 1 shows the rotary torque tong according to the present invention. The tong has a frame 60 generally consisting of a horizontal part 61 and a vertical part 62. The frame 60 may be mounted on a guide rail (not shown) to allow it to be displaced horizontally on a drill floor for the tong to engage or disengage a pipe 70 (shown in FIG. 4).

On the vertical part 62 of the frame 60 there is disposed, as the lowermost component, a holding unit (back-up) 63. This comprises gripping jaws 64 arranged to grip a pipe below a pipe joint (not shown) in order to hold this. The construction of the holding unit is, in principle, conventional and will be understood by a person skilled in the art. Thus this will not be explained in any detail herein.

Above the holding unit 63 there is a rotation unit 65 arranged to grip a pipe above a pipe joint. The rotation unit 65 will be explained in detail in the following. Above the rotation unit 65 there is disposed a spin unit 66. This unit is arranged to spin the pipe above the pipe joint out of threaded engagement with a pipe below the pipe joint, or spin the pipe into threaded engagement with the pipe below the pipe joint. The spin unit has a lighter construction than the rotation unit 65 and operates at a significantly lower torque than the rotation unit. Thus it is not capable of breaking or making a pipe joint. The spin unit 65 may however rotate pipes at a considerably higher speed than the rotation unit 65.

Figure 2:
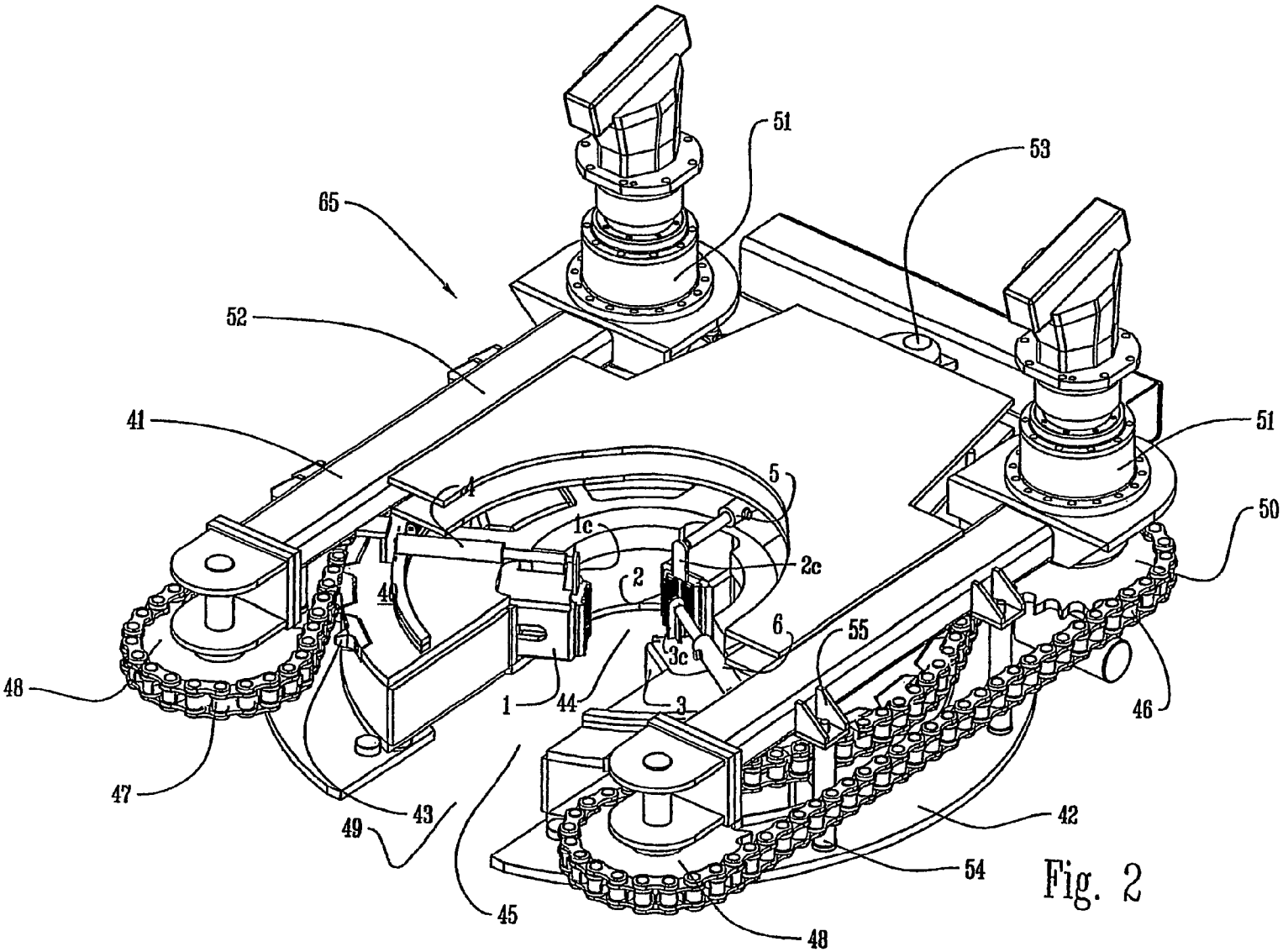
FIG. 2 shows the rotation unit of the torque tong according to the invention.

FIG. 2 shows the rotation unit 65 of the tong according to the invention. It comprises a rotary part 40 and a fixed part 41. The rotary part 40 is mounted on a plate 42 attached to the fixed part via bolts 54 and brackets 55. The plate 42 has an opening 49. The rotary part is generally disk-shaped with a central cavity 44 and an opening 45 extending from the cavity 44 to the periphery of the disk 40. Toothing 43 is provided around the periphery of the rotary part 40. This toothing may consist of single teeth fixed, e.g. screwed, to the disk 40. The toothing 43 engages two chains 46, 47, each of which extends across two cogwheels 48, 50. One of the cogwheels 50 is power-coupled to a motor 51, preferably a hydraulic motor. Alternatively, one chain may be used, which extends across a sector of a circle greater than either of the chains 46, 47. When one chain 46, 47 passes over the opening 45, it is important for the chain to land on the first tooth after the opening as accurately as possible, to avoid wear on the tooth and chain to the greatest possible extent, and to avoid jerky movements. Consequently, the distance over which the chain extends between the teeth on either side of the opening 45 is matched so as to be equivalent to a whole number of teeth. It has been found that this may be achieved by satisfying the following two equations:

$$\frac{t}{2}\cdot\frac{1}{\sin\left(\frac{2\cdot\pi-\alpha}{2\cdot N_2}\right)}=0 \tag{1}$$

$$2\cdot a\sin\left(\frac{N_1\cdot t}{2\cdot r}\right)-\alpha=0 \tag{2}$$

in which:

t is the chain pitch, in mm, $N_1$ is the number of teeth that will fit over the opening 45, between the two teeth nearest the opening, $N_2$ is the number of teeth along the curved section of the rotary part 40, $\alpha$ is the angle (in radians) between the teeth nearest the opening, and r is the radius of the rotary part 40 at the chain, i.e. the distance from the centre of the rotary part 40 to the centre of the chain rollers.

In FIG. 8, the relationship defined above through equations (1) and (2) has been illustrated by an example of an embodiment. The figure shows a schematic plan view of the rotary part 40. Also shown is one chain 46 extending across the two cogwheels 48, 50. A number of teeth 43 are shown around the periphery of the rotary part 40. In the example shown, it has been decided that there should be room for 67 teeth along the curved section of the rotary part 40. However, there is no requirement for such a high density of teeth, and so only every third tooth has been installed, except on either side of the opening 45, where two teeth have been placed close to each other in order to provide greater strength at this location, and diametrically opposite of the opening, where three teeth in a row are missing, in order to achieve symmetry. Using a smaller number of teeth than the maximum possible allows a reduction in costs and makes it easier to mount the teeth.

The rectilinear distance $L_r$ between the two teeth 43*a* and 43*b* closest to the opening 45 on either side of this, is shorter than the curved distance $L_b$, that follows the curve of the rotary part 40. If the chain had followed the curved distance $L_b$ the positioning of the teeth would be given unequivocally by the total number of teeth and the radius r of the rotary part at the chain. The chain will however follow the rectilinear distance $L_r$. Consequently, this distance $L_r$ must provide room for a whole number of teeth. In the example shown, it has been decided that there should be room for 8 teeth along the rectilinear distance $L_r$ between the two teeth 43*a* and 43*b*.

Also, the chain has been chosen to have a pitch, i.e. a distance t between the centres of each of the chain's 46 rollers, of 76.2 mm.

Inserting these figures into the equations (1) and (2) will make it possible to calculate the angle $\alpha$ and the radius r. This gives the radius as 911.7119 mm and the angle $\alpha$ as 0.68176 rad, which is equivalent to 39.06°. If the stretching of the chain 46 between the teeth 43*a* and 43*b* had not been taken into account, the chain would have missed the tooth by 12 mm. This would have resulted in a great strain on this tooth and jerky movements.

The above way of spacing the teeth on a rotary part, and the condition of equations (1) and (2), may also be used in other contexts than that which has been described, where for various reasons, one may wish to have access to an area inside the toothing of the rotary part.

The fixed part 41 comprises a frame 52 that supports the plate 42, the cogwheels 48, 50 and the motors 51. The frame 52 is mounted so as to float in a joint 53. Through this mounting, the rotation unit 65 can automatically orient itself relative to the pipe to be gripped.

The fixed part 41 has gripping cylinders 4, 5, 6 mounted on it. These use their piston rod to push against a protrusion 1*c*, 2*c*, 3*c* on each of three gripping jaws 1, 2, 3. However, the piston rod is not attached to the protrusion. The holding cylinders 1*a*, 2*a*, 3*a* are located inside the gripping jaws 1, 2, 3 and so are not visible in FIG. 2, but one of them may be seen in FIG. 4. Three displaceable gripping jaws may be used, as shown, but it is also possible to use more or fewer gripping jaws. When using fewer gripping jaws, one or more fixed gripping jaws may also be used, which are rigidly mounted to the rotary part. This will depend on how much of the pipe dimension the tong is to be used on.

When the rotary part is to be rotated, the motors 51 are actuated, causing the chains 46, 47 to move in the same direction. Thus the chains 46, 47 rotate the rotary part 40, which slides on slide bearings (not shown) on the plate 42.

In FIG. 3 the fixed part of the rotation unit has been removed. Thus in this figure, two slave cylinders 18 and two master cylinders 19 become visible. Preferably, these are positioned so as to act against each other and synchronously, so that the master cylinder 19 does not contribute to the rotation of the rotary part 40.

The rotation unit 65 is equipped with sensors (not shown) to detect the position of the rotary part 40, to allow the rotary part to be carefully positioned with the opening 45 in line with the opening 49, so that the tong may be pushed onto pipes to be screwed, by guiding the openings 45, 49 onto the pipe. The jaws 1 and 3 closest to the opening 45 have been retracted to make room for the pipe to pass. Therefore these jaws 1 and 3 must be moved over a greater distance than jaw 2 before engaging the pipe.

Description will now be given of a relief mechanism for the holding cylinders. This comprises two plates 57 and 58 which, apart from an opening 45*a* and 45*b*, are annular. The lower plate 58 lies on the rotary part 40 and is operationally connected to three relief valves 10*b*, 11*b*, 12*b* (see FIG. 5). The upper plate 57 is connected to the fixed part 41 via actuators 56. The valves 10*b*, 11*b*, 12, which relieve the pressure from the holding cylinders 1*a*, 2*a*, 3*a* (see FIG. 5), are operated by actuating the actuators 56. The upper plate 57 is forced down against the lower plate 58, which in turn displaces the valves 10*b*, 11*b*, 12*b* from a first position to a second position. The upper plate 57 will be able to force the lower plate down regardless of the position of the rotary part 40 relative to the fixed part 41.

FIG. 4 is a sectional view of part of the rotation unit showing, among other things, one of the motors 51, one of the chains 46, the rotary part 40, the plate 42, one of the gripping cylinders 5, which pushes against the protrusion 2*c* with its piston rod, and one of the gripping jaws 2. One of the holding cylinders 1*a* may be seen inside the gripping jaw 2. Also illustrated is a pipe 70, which has just been gripped by the gripping jaw 2 after the gripping cylinder 5 has advanced this towards the pipe 70.

FIG. 5 shows a possible example of an embodiment of the hydraulic connection for the gripping function of the rotation unit, and also shows a connection for the rotational function. In the figure, components located on the rotary part 40 of the rotation unit 65 are drawn within a line 30. Components outside this are located on the fixed part 41.

On the rotary part 40 are jaws 1, 2, 3, which are designed to grip and hold a pipe 70, as described above.

The jaws 1, 2, 3 are connected to the respective holding cylinder 1*a*, 2*a*, 3*a*. The piston sides of the cylinders 1*a*, 2*a*, 3*a* are connected to respective valve assemblies 10, 11, 12 via respective connecting lines 1*b*, 2*b*, 3*b*. The valve assemblies 10, 11, 12 comprise a check valve 10*a*, 11*a*, 12*a*, that opens for hydraulic communication with the respective holding cylinder 1*a*, 2*a*, 3*a* when the hydraulic fluid is at a certain pressure and stops communication in the opposite direction, and the two-way relief valve 10*b*, 11*b*, 12*b*, which is mentioned in connection with FIG. 3, and which in a first position provides communication with the piston side of the respective holding cylinder 1*a*, 2*a*, 3*a* and stops communication in the opposite direction, and in a second position opens for communication both ways.

The respective check valve 10*a*, 11*a*, 12*a* communicates with the piston side of a slave cylinder 18 via a respective line 10*c*, 11*c*, 12*c*. Preferably, three mechanically connected slave cylinders 18 are provided, but only one is shown in FIG. 5. The respective two-way valve 10*b*, 11*b*, 12*b* also communicates with the piston side of the slave cylinder 18, via a respective line 10*d*, 11*d*, 12*d* and a common check valve 20, which opens for hydraulic communication with the slave cylinder 18 at a certain hydraulic pressure and stops communication in the opposite direction. The lines 10*d*, 11*d*, 12*d* also communicate with a common hydraulic reservoir 16.

The two-way valves 10*b*, 11*b*, 12*b* are operated by a relief actuator 56 that acts on the valves 10*b*, 11*b*, 12*b* via a first plate 57 on the fixed part and a second plate 58 on the rotary part. As shown in FIG. 3, there are preferably at least three relief actuators 56.

The rod side of the slave cylinder 18 communicates with the piston side of the same cylinder 18 via a valve 21. The valve 21 comprises a check valve 21*a*, which opens for communication from the piston side to the rod side and stops communication in the opposite direction, and a choke 21*b* that allows limited hydraulic communication from the rod side to the piston side. The slave cylinder is equipped with a return spring 18*a* that acts to push the piston 18*b* towards the rod side.

The rod sides of the holding cylinders 1*a*, 2*a*, 3*a* communicate with respective valves 13, 14, 15. Each valve 13, 14, 15 comprises a check valve 13*a*, 14*a*, 15*a* that opens for communication from the piston side of the respective holding cylinder 1*a*,2*a*,3*a* and stops communication in the opposite direction, and a choke 13*b*, 14*b*, 15*b* that allows limited hydraulic communication with the rod side. The valves 13, 14, 15 further communicate with a common accumulator 17.

On the fixed part 41 is a hydraulic cylinder 19, which in the following is denoted a master cylinder 19. The master cylinder will, upon actuation and when the slave cylinder 18 is in the correct position for this, use its piston rod 19*a* to push against the piston rod 18*c* of the slave cylinder 18.

When the rotary part 40 is located in such a position as to leave the master cylinder 19 and the slave cylinder 18 facing each other operationally, a respective gripping cylinder 4, 5, 6 will also be located operationally straight opposite the protrusion 1*c*, 2*c*, 3*c* (not shown in FIG. 5) on a respective jaw 1, 2, 3. The three gripping cylinders 4, 5, 6 will, upon actuation in this position, move the jaws 1, 2, 3 to engage the pipe.

On the piston side, the gripping cylinders 4, 5, 6 are hydraulically connected to a respective slave cylinder 31, 32, 33. The pipe 70 is closer to the gripping jaw 6. The slave cylinders 31, 32, 33 are actuated via a synchronizing element 36 of a synchronizing cylinder 34, which is connected to a pump (not shown) via a load holding valve assembly 35. The cylinder 32 is shorter than cylinders 31 and 33, as the gripping cylinder 5 will displace its gripping jaw 2 over a shorter distance to engage the pipe, as explained in connection with FIG. 3.

The piston sides of the gripping cylinders are connected to the pump (not shown) via a respective load holding valve assembly 7, 8, 9.

The hydraulic motors 51 are connected to a pump (not shown) capable of driving the motors 51 in one direction or the other. Each motor 51 is connected to a respective cogwheel 50 via a gear 37. Also shown is a mechanical brake 38 operable via valve assemblies 39*a*, 39*b*.

The principle of operation of the hydraulic connection in FIG. 5 will now be explained in greater detail.

In order to activate the three gripping jaws 1, 2, 3, which form part of the rotary part of the tong, use is made of the three gripping cylinder 4, 5, 6, which are activated and positioned synchronously via synchronizing cylinder 34 and slave cylinders 31, 32, 33. Preferably, the synchronizing cylinder receives hydraulic power from the ring main or a stand-alone hydraulic motor-driven pump, which may be disposed on the tong or near this. The gripping cylinders are controlled by means of the hydraulic load holding valve assemblies 7, 8, 9 and synchronized by the synchronizing cylinder 34 being driven towards the three slave cylinders 31, 32, 33, which are mechanically interconnected via the synchronizing element 36. The slave cylinders 31, 32, 33 are connected to the gripping cylinders 4, 5, 6, so that when the synchronizing cylinder 34 is driven towards the slave cylinders 31, 32, 33, a hydraulic volume flow will be transferred from the respective slave cylinders 31, 32, 33 to the respective gripping cylinders 4, 5, 6, achieving a synchronized movement of the gripping cylinders.

Movement and positioning of the gripping jaws is performed by running the respective gripping cylinders against the protrusion 1*c*, 2*c*, 3, *c* on the jaws 1, 2, 3, the jaws thus being pulled out towards the centre of the cavity 44 until they meet the pipe 70. The gripping cylinders will keep the jaws at a standstill, pressing against the pipe 70.

When the jaws are pulled towards the pipe, they also pull three holding cylinders 1*a*, 2*a*, 3*a* with them, sucking hydraulic oil from the open reservoir 16 through the valve assembly 10, 11, 12 and into the piston side of the holding cylinders 1*a*, 2*a*, 3*a*. The valves 10*b*, 11*b*, 12*b* are then in the position shown in FIG. 1, in which oil is permitted to flow past in the direction of the holding cylinders 1*a*, 2*a*, 3*a*, but is not allowed to flow away from these. The hydraulic oil on the rod side of the holding cylinders 1*a*, 2*a*, 3*a* is evacuated through the valves 13, 14, 15 to the accumulator 17.

In order to increase the clamping force between the gripping jaws and the pipe a volume of oil is delivered to the piston side of the holding cylinders 1*a*, 2*a*, 3*a*. Since the added volume of oil does not generate any movement of the gripping jaws, this added volume of oil will cause the pressure, and consequently the clamping force, to increase. The delivery of this volume of oil is achieved by the master cylinder 19, which is disposed on the fixed part of the tong, pressing against the slave cylinder 18, which is disposed on the rotary part of the tong. This volume of oil flows to the holding cylinders 1*a*, 2*a*, 3*a* via the valves 10*a*, 11*a*, 12*a*. The pressure in the master cylinder 19 is regulated by means of a pressure transmitter in a closed loop with a proportional directional valve (not shown). Since the gear ratio between the master cylinder 19 and the slave cylinder 18 is constant, the pressure in the holding cylinders 1*a*, 2*a*, 3*a* can easily be controlled. Upon reaching the desired pressure, the master cylinder 19 returns to the initial position. When the cylinder 19 returns, the cylinder 18 will follow, due to the return spring 18*a*, and oil will flow from the rod side of the cylinder 18 to the piston side via the valve assembly 21. At the same time, the cylinder 18 will also be refilled from the reservoir 16 via the check valve 20. As the valve assemblies 10, 11 and 12 stop oil flowing away from the holding cylinders 1*a*, 2*a*, 3*a*, these will maintain their clamping force against the pipe.

When the gripping cylinders 4, 5, 6 are also brought back to their initial positions, the tong may rotate freely with the pipe until the desired torque has been obtained. The tong can be rotated as shown by means of hydraulic motors, impellers and chains. The torque is regulated by a closed control loop with torque feed-back from the fixture for the fixed part of the tong and a proportional valve (not shown) connected to the hydraulic motors 51.

The pipe is disengaged from the gripping jaws 1, 2, 3 by operating the relief actuator 56, which via plates 57 and 58 displaces the valve 10*b*, 11*b*, 12*b* in the valve assembly 10, 11, 12 to the position that allows communication in both directions. Thus the pressure will be relieved from the piston side of the holding cylinders 1*a*, 2*a*, 3*a*, relieving the pressure of the gripping jaws. The accumulator 17, which is connected to the rod side of the holding cylinders 1*a*, 2*a*, 3*a*, delivers pressure to the rod side of the holding cylinders 1*a*, 2*a*, 3*a* through choke 13*b*, 14*b*, 15*b*. This pressure ensures that the holding cylinders are returned to their initial position. The chokes 13*b*, 14*b*, 15*b* will control the speed of this return stroke.

FIG. 6 is a simplified view of an alternative hydraulic connection. Here the reservoirs 16 has been removed. The accumulator 17 may be a bladder accumulator filled with nitrogen, as shown, or a piston accumulator. Instead of a return spring in the slave cylinder 18, each holding cylinder 1*a*, 2*a*, 3*a* is equipped with a return spring 1*c*, 2*c*, 3*c*. When the two-way valves 10*b*, 11*b*, 12*b* are open, these return springs will push the pistons of the holding cylinders back, thereby forcing the hydraulic fluid back to the slave cylinder 18 and returning this. The accumulator 17 will also contribute to this. Thus there will be no requirement for a return spring in the holding cylinder.

An alternative solution for increasing the clamping force between the pipe and the gripping jaws after the gripping cylinders have moved these to engage the pipe, is shown in FIG. 7. Instead of using the hydraulic arrangement shown to supply hydraulic power to the holding cylinder, use is here made of the gripping cylinders 4, 5, 6 (FIGS. 7*a, b, c* show only one 4 of the cylinders) to push against an arm 80 connected to a tappet 81 on the gripping jaw 1. In FIG. 7*a* the jaw 1 is fully retracted, and the gripping cylinder 4 is ready to push on the arm 80. In a first phase (see FIG. 7*b*) the gripping cylinder pushes against the arm 80 but without rotating this about the tappet 81. This will move the jaw 1 towards the pipe 70 to engage this. At the same time, the holding cylinder 1*a* is pulled along. The holding cylinder sucks hydraulic fluid from a reservoir (not shown). After the jaw 1 has engaged the pipe 70 and no further displacement of the jaw 1 is possible, the gripping cylinder will start to rotate the arm 80 about the tappet 81. This will cause the tappet 81 to attempt to lengthen the gripping jaw 1. However, this is not possible in the direction of the pipe 70, and so the piston rod and piston of the holding cylinder 1*a* will be forced into the actual cylinder while the centre line 82 of the holding cylinder and the piston rod is rotated over the centre of rotation 83 of the tappet. This will reduce the available volume for the limited quantity of oil in the holding cylinder 1*a*, thus increasing the pressure. The force required by the gripping cylinder 4 to rotate the arm with the tappet 81 and the position of the arm 80 will be related to the pressure in the holding cylinder 1*a*, allowing the clamping force between the pipe 70 and the gripping jaws to be determined and controlled. When the force from the gripping cylinders stops acting on the arm 80, the net force from the pressure against the piston of the holding cylinder 1*a* will attempt to displace the piston forward in the actual cylinder, but as the holding cylinder has rotated about its fixture in the actual cylinder, over the centre of rotation, it will be mechanically locked. The holding cylinder will therefore act as a hydraulic spring.

For the embodiment of FIG. 7, a simplified hydraulic arrangement may be used, which includes no master and slave cylinders, but which will include valves for relieving hydraulic pressure from the holding cylinders, in accordance with the principles illustrated in FIGS. 5 and 6.

Return of the jaws can be achieved e.g. by opening a valve (equivalent to valves 10*b*, 11*b*, 12*b*) that relieves the pressure from the holding cylinders. The jaws will be retracted, either by means of a return spring or by hydraulic pressure.

The arm 80 with the tappet 81 may be equipped with a return spring (not shown) to bring it back to its initial position. Alternatively, the return of the arm 80 can be brought about through gravity alone.

An alternative embodiment for synchronization of the gripping cylinders would be to have position measurement for each gripping cylinder with separate proportional valves, to allow the gripping cylinders to be individually positioned and thereby synchronized.

What is claimed is:

1. A rotational unit for a torque tong, comprising:

a fixed part; and a rotary part designed to grip a pipe to be rotated, said rotary part comprising:

at least one movable gripping jaw arranged to be moved into engagement with the pipe;

toothing arranged to engage at least one chain, the toothing including teeth, said at least one chain being operatively connected to an actuator in order to move the at least one chain and so impart rotary movement to the rotary part; and an opening at a periphery thereof for introduction of a pipe, wherein the at least one chain extends across a sector of a circle larger than the opening, thus ensuring that the at least one chain and the toothing on the rotary part are engaged at all times, the opening is arranged to be kept open during the rotation of the rotary part, and a rectilinear distance over which the at least one chain extends between the teeth of the toothing located closest to and on either side of the opening is equivalent to a whole number of teeth, wherein the distribution of the teeth on the rotary part is defined by:

$$\frac{t}{2}\cdot\frac{1}{\sin\left(\frac{2\cdot\pi-\alpha}{2\cdot N_2}\right)}=0 \tag{1}$$

$$2\cdot a\sin\left(\frac{N_1\cdot t}{2\cdot r}\right)-\alpha=0 \tag{2}$$

in which:

t is the chain pitch, in mm, $N_1$ is the number of teeth that will fit between the two teeth nearest the opening, $N_2$ is the number of teeth along the curved section of the rotary part 40, $\alpha$ is the angle (in radians) between the teeth nearest the opening, and r is the radius of the rotary part at the at least one chain, the radius being the distance from a center of the rotary part to a center of the chain.

2. A unit according to claim 1, characterized in that $N_1$ is equal to 8.

3. The unit according to claim 2, wherein the rotary part engages at least two chains that act synchronously.

4. The unit according to claim 2, wherein the rotary part has replaceable teeth.

5. The unit according to claim 2, wherein the at least one chain extends over a first cogwheel operatively connected with a motor, and a second cogwheel that acts as a turning wheel, which cogwheels are spaced apart at the periphery of the rotary part.

6. The unit according to claim 1, wherein the rotary part engages at least two chains that act synchronously.

7. The unit according to claim 6, wherein the at least two chains are arranged on diametrically opposite sides of the rotary part.

8. The unit according to claim 1, wherein the rotary part has replaceable teeth.

9. The unit according to claim 1, wherein the at least one chain extends over a first cogwheel operatively connected with a motor, and a second cogwheel that acts as a turning wheel, which cogwheels are spaced apart at the periphery of the rotary part.

10. The unit according to claim 1, wherein the rotary part is slidingly supported on a plate on the fixed part.

* * * * *